US007309050B2

(12) United States Patent
Heinze et al.

(10) Patent No.: US 7,309,050 B2
(45) Date of Patent: Dec. 18, 2007

(54) GROOVED RAIL CORE PIECE

(75) Inventors: Fridbert Heinze, Uelleben (DE); Thomas Christ, Oberdorla (DE); Torsten Reck, Gotha (DE)

(73) Assignees: BWG GmbH & Co., KG, Butzbach (DE); VAE GmbH, Vienna (AT)

( * ) Notice: Subject to any disclaimer, the term of this patent is extended or adjusted under 35 U.S.C. 154(b) by 342 days.

(21) Appl. No.: 10/542,858

(22) PCT Filed: Mar. 10, 2004

(86) PCT No.: PCT/EP2004/002447

§ 371 (c)(1),
(2), (4) Date: Sep. 8, 2005

(87) PCT Pub. No.: WO2004/081286

PCT Pub. Date: Sep. 23, 2004

(65) Prior Publication Data

US 2006/0054746 A1 Mar. 16, 2006

(30) Foreign Application Priority Data

Mar. 12, 2003 (DE) ..... 103 11 113

(51) Int. Cl.
*E01B 7/00* (2006.01)

(52) U.S. Cl. ..... 246/460; 246/463; 246/468; 246/470; 246/472

(58) Field of Classification Search ..... 246/460, 246/454, 463, 458, 459, 461, 462, 464, 465, 246/467, 468, 470, 472
See application file for complete search history.

(56) References Cited

U.S. PATENT DOCUMENTS

| | | | | |
|---|---|---|---|---|
| 765,526 | A * | 7/1904 | Vaughan | 246/468 |
| 885,298 | A * | 4/1908 | Rost | 246/460 |
| 895,698 | A * | 8/1908 | Strong | 246/460 |
| 934,213 | A * | 9/1909 | Price | 246/460 |
| 940,441 | A * | 11/1909 | Dotter | 246/460 |
| 1,072,866 | A * | 9/1913 | McEvoy | 246/460 |
| 1,461,701 | A * | 7/1923 | Psilander | 246/460 |

(Continued)

FOREIGN PATENT DOCUMENTS

DE 10114683 10/2002

(Continued)

*Primary Examiner*—Mark T. Le
(74) *Attorney, Agent, or Firm*—Dennison, Schultz & MacDonald

(57) ABSTRACT

A grooved rail core piece including a core piece intersection area formed by intersecting grooves as an overflow area. The core piece has two construction profiles with interconnected outer fishing surfaces (22,24) extending in a longitudinal direction. In order to enable the intersection area of the core piece to be renewed in a simple manner, the intersection-point area of the core piece includes an interchangeable insert (36) which is arranged in a recess in an at least positive fit, the recess being defined by the sections of the construction profiles and by the sections of the lining parts (30,32) disposed in the outer fishing surfaces (22, 24), and the insert is fixed by means of at least two wedge elements (38, 40) which can be clamped in the lining parts. The lining parts and the construction profiles are connected by means of at least one clamping element protruding there through in a non-positive fit.

14 Claims, 3 Drawing Sheets

U.S. PATENT DOCUMENTS

| | | | | | |
|---|---|---|---|---|---|
| RE22,630 | E | * | 4/1945 | Breed | 246/470 |
| 2,853,260 | A | * | 9/1958 | Simmons et al. | 246/468 |
| 3,764,802 | A | * | 10/1973 | Webster | 246/468 |
| 5,653,408 | A | * | 8/1997 | Kuhn | 246/470 |

FOREIGN PATENT DOCUMENTS

| | | |
|---|---|---|
| EP | 1138830 | 10/2001 |
| GB | 02608 | 0/1911 |

* cited by examiner

C-C:

D-D:

GROOVED RAIL CORE PIECE

This application is a 371 of PCT/EP04/02447, filed Mar. 10, 2007.

The invention relates to a grooved rail frog including a frog intersection region formed by intersecting grooves as an overrun region as well as two construction profiles extending in the longitudinal direction of the frog and connected with each other with external fishplate chambers comprising lining pieces, which are connected non-positively to the construction profiles through at least one tightening element such as screw bolts penetrating these, wherein the frog intersection point region includes an interchangeable insert, which is arranged non-positively in a recess.

Known grooved rail frogs consist of a frog block whose faces are welded to connection rails. Intersecting rails are incorporated in the block itself to construct a wheel overrun region, the rails usually passing over into those of the connection rails.

Casting frogs is also known, even if a solution in this relation is expensive and cost intensive.

A rail frog is known from EP 0 533 528 B1 in which a slab is used as the starting material, which is slit proceeding from its faces and the segments are then spread.

The solution suggestions outlined above consequently proceed from the assumption that the grooved rail frog consists of a homogenous material in the region of the intersecting grooves, wherein a connection with the connection rails takes place at a more or less great distance to the point of intersection.

A grooved rail frog type is known from German Patent 190 15 522 A1, which includes two construction profiles extending in the longitudinal direction of the frog to whose respective course half of the frog corresponds regarded in its longitudinal direction. Then the construction profiles are welded in the frog intersection point region in the longitudinal direction. Such a design results in the advantage that the frog region can be constructed shorter. This consequently results in a compact design, which allows a large frog angle without the traveling comfort of a motor vehicle passing through a corresponding frog being impaired.

If the transition region is worn, renovation can take place by means of build-up welding. Alternatively the frog is exchanged. For this, it is necessary in the case of a grooved rail frog embedded in a subgrade to open the cover and close it again after replacement. This is time consuming and expensive.

The grooved rail frog of the type mentioned at the beginning can be inferred from European Patent 1 138 830 A2. The insert forming in the overrun region is thereby accommodated non-positively between head regions of the construction profiles running along the frog. The non-positive connection is achieved with screw bolts, which run beneath the insert and are braced upon lining pieces, which are arranged in outer fishplate chambers of the construction profiles. Should the insert be replaced, it is necessary to expose the frog arranged in a subgrade in order to be able to loosen the screw bolts.

The present invention is based upon the problem of further developing a grooved rail frog of the type mentioned at the beginning such that with simple measures replacement or fixing and loosening of the insert is possible without a subgrade necessarily having to be opened.

For solving the problem, it is basically proposed in accordance with the invention that the recess accommodating the insert is bounded by sections of the lining pieces arranged in the outer fishplate chambers of the construction profiles and that the insert is fixed in place in relation to the lining pieces. Moreover the insert is preferably delimited in segments by the lining pieces as well as delimited in segments by the construction profiles, specifically in the floor-side region of the insert. The limitation in particular takes place by the bar segment of the construction profiles.

In accordance with the invention, construction profiles are used on the one hand to construct the frog, owing to which the advantages resulting from German Patent 100 15 522 A1 are attainable. On the other hand, the frog cross region, which is exposed to high wear and tear, is constructed as an insert and in particular fixed in position through the wedge elements such that trouble-free replacement, for example after reaching the wear and tear limit value, is possible without opening the cover of a subgrade in a time-consuming and expensive manner. At the same time, it is assured that the insert is fixed in place by means of the wedge elements in a form-fitting and non-positive manner in the recess delimited by the lining pieces so that a jerk-free transition between the insert and the adjacent sections of the construction profiles is guaranteed.

Wide inserts can also be used without particular shapes of the construction profiles being needed due to the fixation in relation to the lining pieces joined with the construction profiles.

For secure tensioning of the insert, the latter has exterior surfaces running obliquely outward, wherein a wedge element with a first surface adapted to the contour of the outer surface rests on each external surface, and the wedge element is braced with a second surface in particular running opposite the first surface on the lining piece or a section thereof.

In other words, the insert is configured such that the latter has lateral surfaces running in the longitudinal direction of the insert which run inclined toward the vertical—for example with an incline between 1:5 and 1:7, especially 1:6—in order to be tensioned using the wedge elements (also called chucking wedges) at the same inclination on opposite sides.

The incline of the lateral or outer surfaces run in opposite directions and enclose an acute angle with the bottom surface of the insert or its extension.

The wedge elements or chucking wedges to be used are moreover basically known, specifically in conjunction with the non-welded connection of a tongue blade and a connection rail in with the case of grooved rail switches as these are to be inferred from German Patent 42 44 010 A1, to the disclosure of which express reference is made.

Lining pieces, which contain the necessary forming elements for tightening the wedge elements and to which the construction profiles are screwed in a highly rigid manner, are provided to stabilize the frog and to widen the latter.

In particular, the wedge element has a trapezoidal geometry, especially a trapezoidal shape with unequal sides, with a greater base side extending on the upper side.

To tighten a wedge element, the latter is penetrated by a screw element that can be tightened in relation to the lining element. Moreover the screw element can be a hammer head bolt or engage a T-shaped tenon block, which extends in a T-groove in the lining piece that runs underneath the wedge element.

It is provided in further development of the invention that the lining piece has, facing away from the insert, a bar-like segment extending approximately to the plane formed by the traveling surface of the frog, wherein the intermediate space between the bar-like segment and the insert is covered. Moreover the intermediate space can be covered by a protective element or sheet, which runs above the wedge element on the outer surface side preferably in the plane formed by the running surface. Consequently, the wedge element is arranged in a sunk manner covered with a protective element and consequently protected against street traffic and its stress. Furthermore a seal can run between the protective element and on the one hand the bar-like segment of the lining piece and on the other the insert for protection against corrosive environmental stresses.

If the construction profiles extend in the region of the insert parallel or approximately parallel to one another, these diverge to the necessary extent at a distance to the frog intersection point region, wherein the construction profiles then are braced in a highly rigid manner against one another through intermediate elements such as wedge braces and through second tightening elements such as screw bolts.

The lining pieces, which are to be designated as support rails, are embedded in a form-locking manner into the outer fishplate chambers of the construction profiles, which can, for example, be D180/105 thick bar rails and are screwed pre-stressed in a highly rigid manner and systematically to the construction profiles.

Further details, advantages and features of the invention emerge not only from the claims, the features to be inferred from these—in isolation and/or in combination—but also on the basis of the subsequent description of a preferred embodiment to be inferred from the drawings, wherein:

Figure 1:
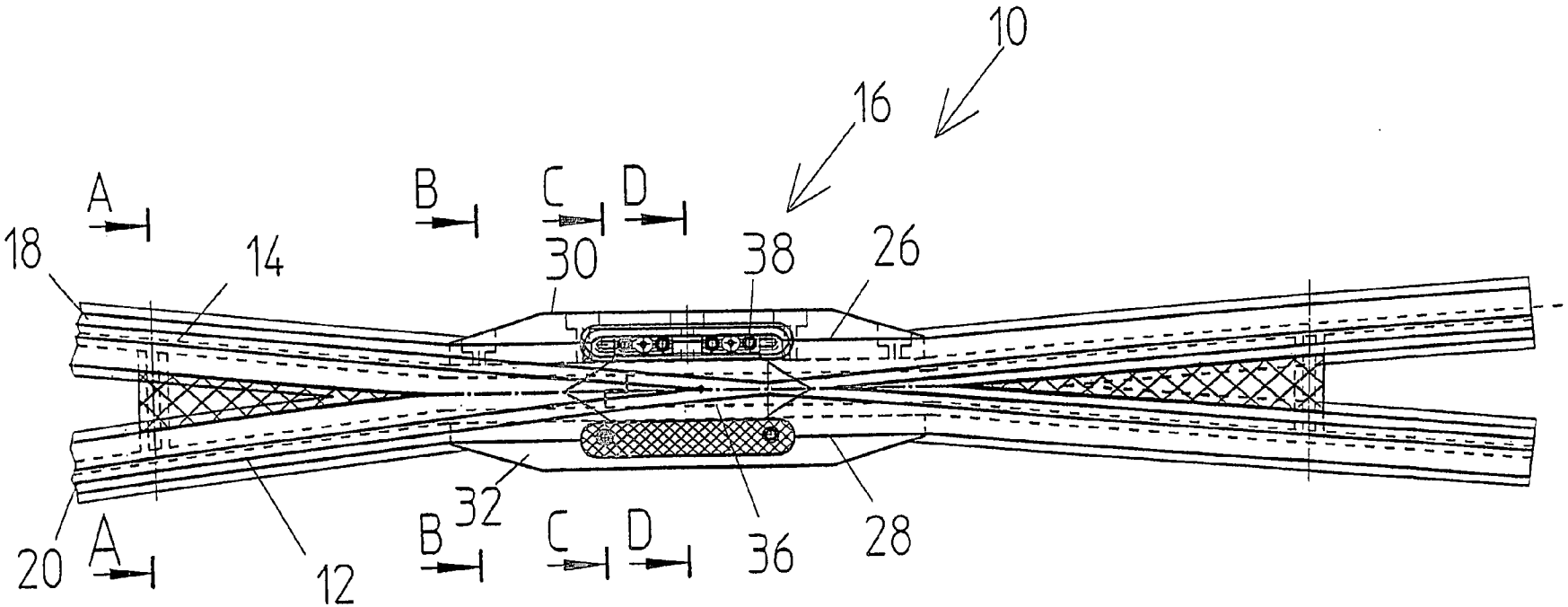
FIG. 1 Shows a top view of a grooved rail frog.
Figure 2:
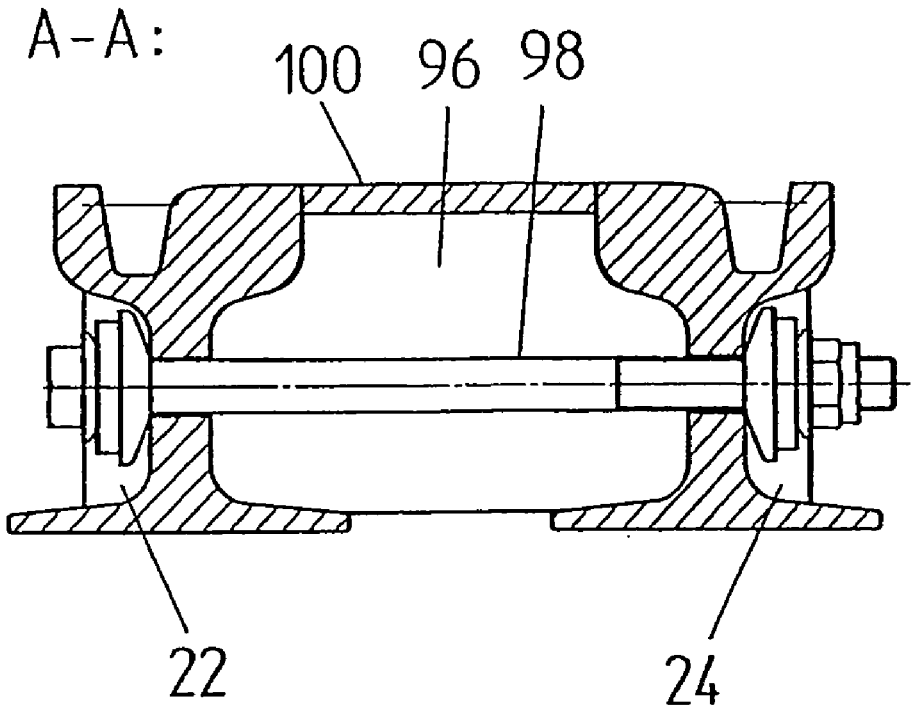
FIG. 2 Shows a section along line A-A in FIG. 1.

A groove rail frog 10 is represented purely in principle in FIG. 1, in which intersecting grooves 12, 14 run in the known manner. The frog intersection point region, in which the grooves 12, 14 cross, to be characterized as the wheel overrun region has been designated with the reference number 16.

The grooved rail frog 10 consists of two construction profiles 18, 20, which can be constructed as full head profiles in the initial state. Thick bar rails, such as D180/105 or square profiles, for example, are possible construction profiles, without restricting the doctrine of the invention taking. Nonetheless, it is essential that the construction profiles at least have fishplate chambers 22, 24 on the exterior. The construction profiles 18, 20 are now bent and oriented toward one another such that they correspond to the shape of the finished grooved rail frog 10 divided in its longitudinal axis.

Figure 5:
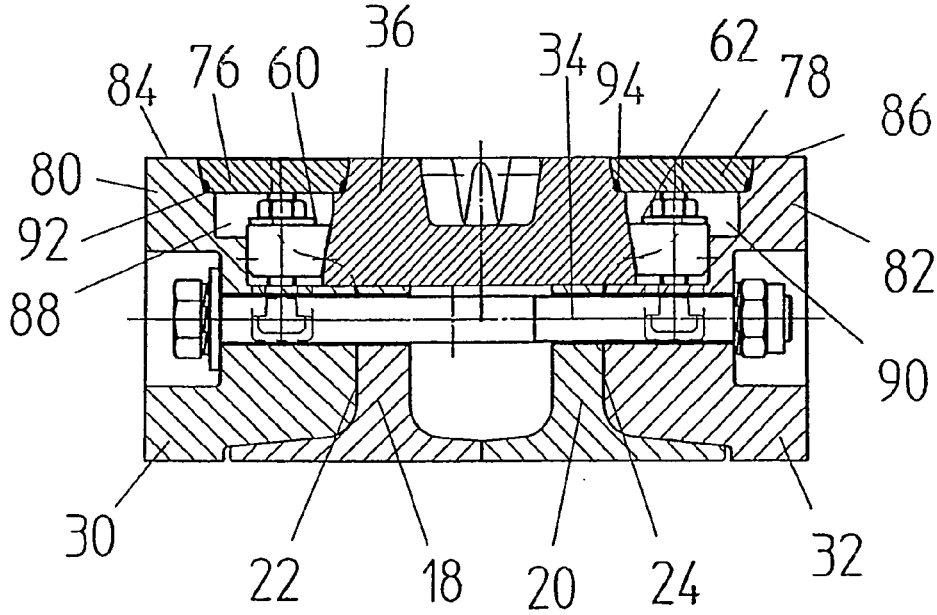
FIG. 5 Shows a section along line D-D in FIG. 1.

The construction profiles 18, 20 run parallel to one another in the longitudinal direction of the frog 10 and in the region of the frog intersection region 16, as is supposed to be indicated by lines 26, 28. In this region, widening lining pieces 30, 32 are embedded in particular in a form-locking manner in the outer fishplate chambers 22, 24 of the frog region and are screwed in a highly rigid manner with systematic prestressing to the construction profiles 18, 20. This is illustrated in FIG. 5. Thus a bolt 34 penetrates the lining pieces 30, 32 and the construction profiles 18, 20 to screw these together in a highly rigid manner with methodical prestressing.

Furthermore, it is provided in accordance with the invention that the grooves 18, 20 intersect in an insert that is arranged forming a non-positive and force-locking manner in a recess, which is delimited by the construction profiles 18, 20 and the lining pieces 30, 32, as is apparent on the basis of the figures. Moreover the insert 36 can consist of wear and tear-proof or very wear and tear-proof material, without the construction profiles 18, 20 having to be made of the same material. The insert 36 moreover runs above the bolt 34.

In the embodiment, the recess is delimited to the side of the lining pieces 30, 32 and below or on the bottom side of the construction profiles 28 or bars thereof.

In order to ensure a force-locking connection between the insert 36 and the lining pieces 30, 32, wedge elements 38, 40 designated as chucking wedges are provided, which are on the one hand braced on outer surfaces 42, 44 of the insert 36 and on the other on inner surfaces 46, 48 of the lining pieces 30, 32. Moreover the outer surfaces 42, 44 run inclined and enclose an acute angle proceeding from the insert 36 to its bottom surface 50. In particular, the incline of the external surface 42, 44 is approximately 1:6. A surface 52, 54 of the wedge element 38, 40 runs correspondingly adapted and inclined on the respective outer surface 42, 44. The opposite surface 56, 58, which is braced on surface 46, 48 of the lining piece 30, 32, in contrast preferably runs vertically. Consequently each wedge element 38, 40 has a trapezoidal shape in section, wherein the greater base segment 60, 62 runs on the upper side, thus in the region of the color surface.

Each wedge element 38, 40 can be penetrated by a screw such as a hexagonal screw 64, 66 and engage into a T-shaped tenon block 68, 70, which parting turn runs in a T-shaped groove 72, 74, which is embedded in the lining piece 30, 32 beneath the wedge element 38, 40. A T-groove 72, 74 is provided per wedge element 38, 40 whose dimensioning, especially length, is harmonized with the spacing of the screws 64, 66 of the chucking wedge 38, 40. An opening is incorporated in the middle of the respective T groove 72, 74 to insert the tenon block 68, 70. Instead of a tenon block, in which a screw engages, a hammer head screw or a similarly acting element can be used.

As the drawing representations make clear, the wedge elements 38, 40 are arranged sunk in the lining pieces 30, 32. In addition, the wedge element 38, 40 can be covered by a covering 76, 78, such as a protective sheet, which extends between the insert 36 and an external bar-like segment 80, 82 of the lining piece 30, 32. Moreover the bar-like segment 80, 82 extending in the longitudinal direction of the frog 10 runs with its upper side 84, 86 preferably on a plane that is formed by the travel surface of the frog.

If in the embodiment the protective elements or sheets 76, 78 taper toward the floor, i.e. are conically constructed, then another shape may be chosen. Preferably, however, the protective sheets 76, 78 are sealed toward the intermediate space 88, 90 running between the insert 36 and the bar-like segments 80, 82, for example, by a rubber seal 92, 94.

Outside the frog intersection point region 16, thus the region in which on the one hand the grooves 12, 14 intersect and on the other hand the construction profiles 18, 20 run parallel or basically parallel to one another or rest against one another, the construction profiles 18, 20 are braced by means of spacing elements such as wedge braces 96 and then screwed together in a highly rigid manner using further clamping elements such as bolts 96. In this region which can, for example, correspond to a spread of 160 mm, the intermediate space between the construction profiles 18, 20 is covered by a protective sheet, such as a bulb plate 100.

Figure 3:
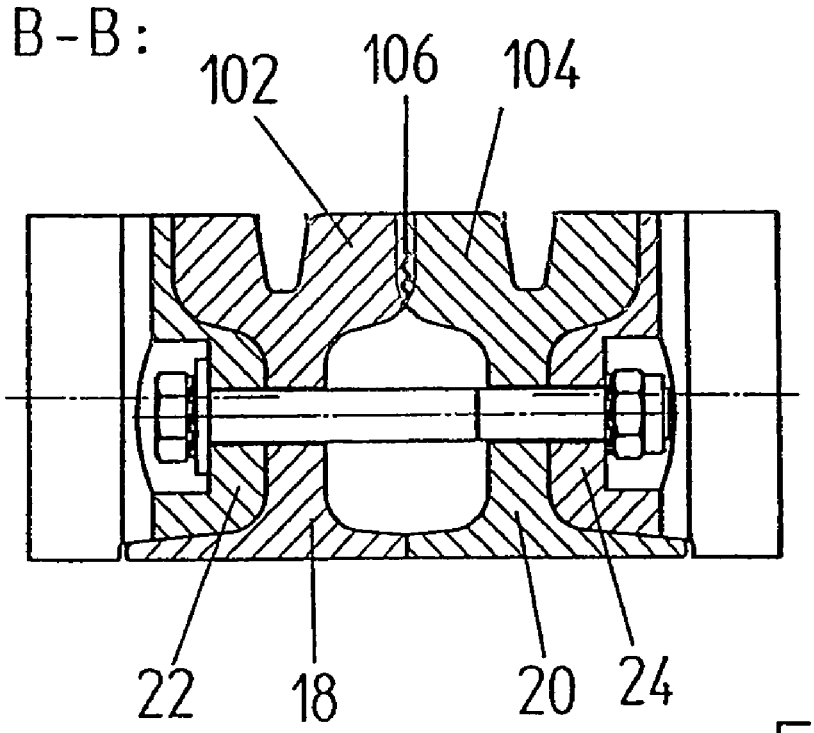
FIG. 3 Shows a section along line B-B in FIG. 1.
Figure 4:
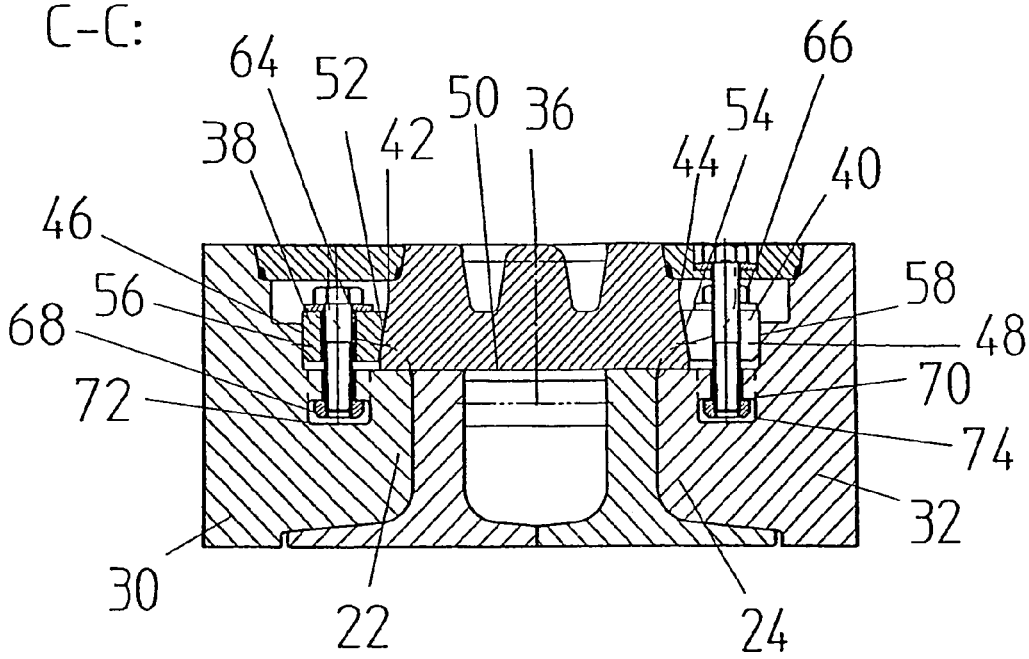
FIG. 4 Shows a section along line C-C in FIG. 1.

It furthermore becomes apparent from FIG. 3 that in the region of the frog intersection point 16 the construction profiles 18, 20 resting with their heads 102, 104 against on one another, engage in a form-locking manner with one another, for example by a gearing, in order to rule out additionally a vertical displacement. This region is characterized with reference number 106 in FIG. 3.

The invention claimed is:

1. Grooved rail frog (10) including a frog intersection region (16) formed by intersecting grooves (12, 14) as an overrun region as well as two construction profiles (18, 20), extending in the longitudinal direction of the frog and being connected with each other, with outer fishplate chambers (22, 24) with lining pieces (30, 32) arranged in the chambers, the lining pieces being connected non-positively with the construction profiles by means of at least one tightening element (34) penetrating the lining pieces and the construction profiles, wherein the frog intersection point region comprises an interchangeable insert (36), which is arranged non-positively in a recess, wherein the recess accommodating the insert (36) is delimited by segments of the lining pieces (30, 32) arranged in the outer fishplate chambers (22, 24) of the construction profiles (18, 20), and wherein the insert is fixed in place in relation to the lining pieces.

2. Grooved rail flog according to claim 1, wherein the insert (36) is delimited by the segments of the lining pieces (30, 32) as well as by segments of the construction profiles (18, 20), especially by bars of the construction profiles.

3. Grooved rail frog according to claim 2, wherein the insert (36) has outer surfaces (42, 44) running inclined toward vertical, wherein at least one wedge element (38, 40) rests on each outer surface with a first surface (52, 54) corresponding to a course of the outer surface, and wherein the wedge element is braced with a second surface (56, 58) running opposite to the first surface on one of the lining pieces (30, 32), respectively.

4. Grooved rail frog according to claim 3, wherein the wedge element (38, 40) has a trapezoidal shape in section with larger base segments (60, 62) running on a travel surface side.

5. Grooved rail frog according to claim 3, wherein the wedge element (38, 40) is penetrated by a screw element (64, 66), which can be tightened in relation to the lining piece (30, 32).

6. Grooved rail frog according to claim 5, wherein the screw element (64, 66) is a hammer head screw or engages in a T-shaped tenon block (68, 70), which extends in a T-shaped groove (72, 74) running in the lining piece (30, 32).

7. Grooved rail frog according to claim 1, wherein the lining piece (30, 32) has on a side facing away from the insert a bar-like segment (80, 82) extending approximately to a plane formed by a travel surface of the frog (10), and wherein an intermediate space (88, 90) between the bar-like segment and the insert (36) is covered.

8. Grooved rail frog according to claim 7, wherein the intermediate space (88, 90) containing a wedge element (38, 40) is covered by a protective element or sheet (76, 78) that runs above the wedge element and on an outside in a plane formed by the travel surface of the frog (10).

9. Grooved rail frog according to claim 8, wherein the protective element (76, 78), which tapers conically in a direction of the intermediate space (88, 90), is sealed off against the lining piece (30, 32) at its bar-like segment (80, 82) as well as the insert (36).

10. Grooved rail frog according to claim 1, wherein the construction profiles (18, 20) run parallel or basically parallel to one another in the region of the insert (36).

11. Grooved rail frog according to claim 1, wherein the construction profiles (18, 20) running diverging in relation to one another outside the insert (36) are braced against one another by means of an intermediate element and are screwed together in a highly rigid manner by means of at least a second tightening element (98).

12. Grooved rail frog according to claim 1, wherein the lining pieces (30, 32) are embedded in a form-locking manner in the outer fishplate chambers (22, 24) and screwed together in a highly rigid manner with the construction profiles (18, 20) with systematic prestressing.

13. Grooved rail frog according to claim 1, wherein the insert (36) is arranged in a non-positive and form-locking manner in the recess delimited by the construction profiles (18, 20) and the lining pieces (30, 32).

14. Grooved rail frog according to claim 3, wherein the outer surfaces (42, 44) of the insert (38) running inclined toward vertical have an incline between 1:5 and 1:7.

* * * * *